US010662593B1

(12) United States Patent
Smith

(10) Patent No.: US 10,662,593 B1
(45) Date of Patent: May 26, 2020

(54) DRAG BOX APPARATUS

(71) Applicant: Keith E Smith, Kathleen, FL (US)

(72) Inventor: Keith E Smith, Kathleen, FL (US)

( * ) Notice: Subject to any disclaimer, the term of this patent is extended or adjusted under 35 U.S.C. 154(b) by 0 days.

(21) Appl. No.: 16/240,986

(22) Filed: Jan. 7, 2019

(51) Int. Cl.

| | |
|---|---|
| ***E01C 23/08*** | (2006.01) |
| ***E01C 11/00*** | (2006.01) |
| ***B28D 7/02*** | (2006.01) |
| ***E01C 23/082*** | (2006.01) |

(52) U.S. Cl.
CPC ..... *E01C 23/082* (2013.01); *E01C 11/005* (2013.01); *B28D 7/02* (2013.01); *E01C 2301/50* (2013.01)

(58) Field of Classification Search
CPC .. E01C 23/082; E01C 11/005; E01C 2301/50; E01C 19/48; E01C 19/185; B28D 7/02
See application file for complete search history.

(56) References Cited

U.S. PATENT DOCUMENTS 2,078,900 A * 4/1937 Biles ..... E01C 19/266 404/85
2,724,314 A * 11/1955 Evans ..... A01B 3/38 172/449
2,818,664 A * 1/1958 Bond ..... E02F 3/7663 172/799.5
2,828,556 A * 4/1958 Drum ..... E01C 23/082 172/784
2,886,906 A * 5/1959 Moses ..... A01B 31/00 172/150
2,940,193 A * 6/1960 Banks ..... E02F 3/7686 172/706
3,010,523 A * 11/1961 Gifford ..... A01B 43/00 171/63
3,022,060 A * 2/1962 Cook ..... E02F 3/8157 267/120
3,151,348 A * 10/1964 Maasberg ..... E01C 23/00 15/320
4,655,297 A * 4/1987 Bourgeois, Jr. ..... E02F 3/7622 172/445.1
4,700,786 A * 10/1987 Berry ..... E01C 23/082 172/780
5,199,196 A * 4/1993 Straley ..... E01C 21/00 111/118
5,332,331 A * 7/1994 Critz ..... E01C 19/15 172/393
5,397,200 A * 3/1995 Seal ..... E02F 3/7627 172/393
5,427,185 A * 6/1995 Seal ..... E02F 3/7627 172/197
5,918,684 A * 7/1999 Tozer ..... E01H 1/12 172/199
6,168,348 B1 * 1/2001 Meyer ..... E02F 3/7663 404/84.1

(Continued)

*Primary Examiner* — Abigail A Risic
(74) *Attorney, Agent, or Firm* — William M. Hobby, III

(57) ABSTRACT

A drag box or box scraper for scraping and moving loose materials on a surface uses a three point hitch having a pivotally mounted blade box holding a scraping blade attached thereto to allow the scraping blade to pivot to ride over rigid objects, such as man hole covers during road preparations. Attached water tanks add weight to the drag box and feeds a water sprayer used for dust suppression.

9 Claims, 4 Drawing Sheets

(56) References Cited

U.S. PATENT DOCUMENTS

| | | | | |
|---|---|---|---|---|
| 6,308,785 | B1 * | 10/2001 | Rhoden | A01B 31/00 172/393 |
| 6,419,030 | B1 * | 7/2002 | Turner | E01C 23/082 172/611 |
| 6,843,001 | B2 * | 1/2005 | Jenne | E02F 3/7618 37/93 |
| 7,584,805 | B2 * | 9/2009 | Skaggs | E02F 3/40 172/445.2 |
| 8,083,005 | B1 * | 12/2011 | Nicolai | E02F 3/7631 172/393 |
| 8,393,406 | B2 * | 3/2013 | Seal | E02F 3/7627 172/393 |
| 9,546,455 | B2 * | 1/2017 | Forbes | E01C 5/14 |
| 10,119,243 | B2 * | 11/2018 | Chern | A01B 29/00 |
| 2009/0078436 | A1 * | 3/2009 | Skaggs | E02F 3/40 172/1 |
| 2016/0115653 | A1 * | 4/2016 | Forbes | E01C 5/14 404/35 |
| 2017/0034988 | A1 * | 2/2017 | Meredith | E01C 23/082 |
| 2017/0292244 | A1 * | 10/2017 | Atherton | E02F 3/8157 |
| 2018/0127948 | A1 * | 5/2018 | Villalba Hern ndez | A01B 63/004 |

* cited by examiner

DRAG BOX APPARATUS

FIELD OF THE INVENTION

The invention relates to the improvement to a common box/scrape blade commonly mounted to a three-point hitch system on the rear of a tractor and used to remove loose material on dirt surfaces.

BACKGROUND OF THE INVENTION

This invention relates to a drag box or box scraper for scraping and moving loose or stuck debris on road surfaces being prepared to be resurfaced or paved. Drag box scrapers have been commonly used for years to drag road building materials from the surface of a road under construction or renovation.

Drag boxes are commonly connected to a tractor or other vehicle with a three point hitch. The three point hitch is used to attach an implement to a tractor and transfers some of the weight and resistance of the drag box to the drive wheels of the tractor.

Drag boxes can have a problem due to the curve blades and the fact that the blades are mounted to the rear of the box commonly used on soil beds that are being graded level.

The drag box of the present invention rides on replaceable side shoes mounted to the side plates of the drag box frame which allows for a main scraping edge that is mounted in the center of the box and allows for the box to have the same debris holding capacity in the forward or reverse direction.

The main scraping edge is flat not a curved blade as in a blade used to remove dirt on soft surfaces. The flat vertically main blade described on the current invention is necessary to allow the blade to be able to relieve itself from objects such as manholes commonly found on road surfaces being prepared for resurfacing.

The drag box is mounted to the three point hitch frame by means of a pivot. The pivotable actions allow the box to flex independent of the three point hitch. This pivotable action is necessary during the intended use of the described box scraper. During the cleaning or scraping operations it is common for obstacles such as manholes to be covered with debris. During the scraping process of dragging a common dirt box blade on hard road surfaces using a curved blade mounted to the rear of the box can get stuck on an elevated manhole cover or access ports. When the common dirt style box blade engages these types of obstacles, the blade can become lodged thereagainst causing damage to the box blade, tractor and operator. The present invention provides for the box to tilt by means of the pivot capabilities allowing the straight or flat vertical center mount blade to change its angle of contact allowing the blade to slip over the obstacle. The side shoes combined with the center mounted main blade also work together along with the pivotable capability to lift the main scraping edge over the obstacle.

The three point hitch allows for the removable mounting of a pair of water tanks on the three point hitch box to provide additional weight for the drag box and which water tanks are connected to a water sprayer system to spray liquid for dust suppression in the road preparation process.

SUMMARY OF THE INVENTION

A drag box uses a three point hitch mounted frame having a pivotally mounted blade box holding a scraping blade attached to allow the scraping blade to pivot to ride over rigid objects, such as manhole covers in the road surface repaving and maintenance operation.

A blade box frame has a pair of side frame members each having a removable shoe or skid attached thereto for the blade box frame to slide on. The blade box frame has a blade attached between the side frame members and the blade box frame has a pair of support frame members. A three point hitch having a frame is separately attached to the blade box frame with a pivotal connection and is removably attachable to a vehicle for pulling the drag box. The three point hitch frame has a pair of cushion support bars having a pivoting connection to the blade box frame to thereby allow the blade box frame and blade to pivot on the three point hitch frame. Each of the cushion support bars has a resilient cushion mounted thereon positioned for resting on blade box frame support members. The drag box frame and blade is thus allowed to move relative to the three point hitch frame when the box frame main scraping edge contacts an obstacle thereby tilting the blade to ride over the obstacle.

BRIEF DESCRIPTION OF THE DRAWINGS

The accompanying drawings, which are included to provide further understanding of the invention, are incorporated in and constitute a part of the specification and illustrate an embodiment of the invention and together with the description serve to explain the principles of the invention.

In the drawings.

DETAILED DESCRIPTION OF AN EXEMPLARY EMBODIMENT

The present invention is for a box scraper or drag box which are commonly attached to a tractor, or the like, and used to scrape or move loose material on the a road bed or other surface. A three point hitch for attaching to the tractor is on a separate frame from the blade box and is pivotally attached to the blade box at a pivot point to allow the blade box and blade to pivot independently of the three point hitch to enable the blade to ride over rigid objects, such as man hole covers, during dirt removal operations. The present drag box also has a pair of water tanks which add weight to the drag box while providing water to a sprayer for holding water for spraying scraped surfaces for dust suppression.

Figure 1:
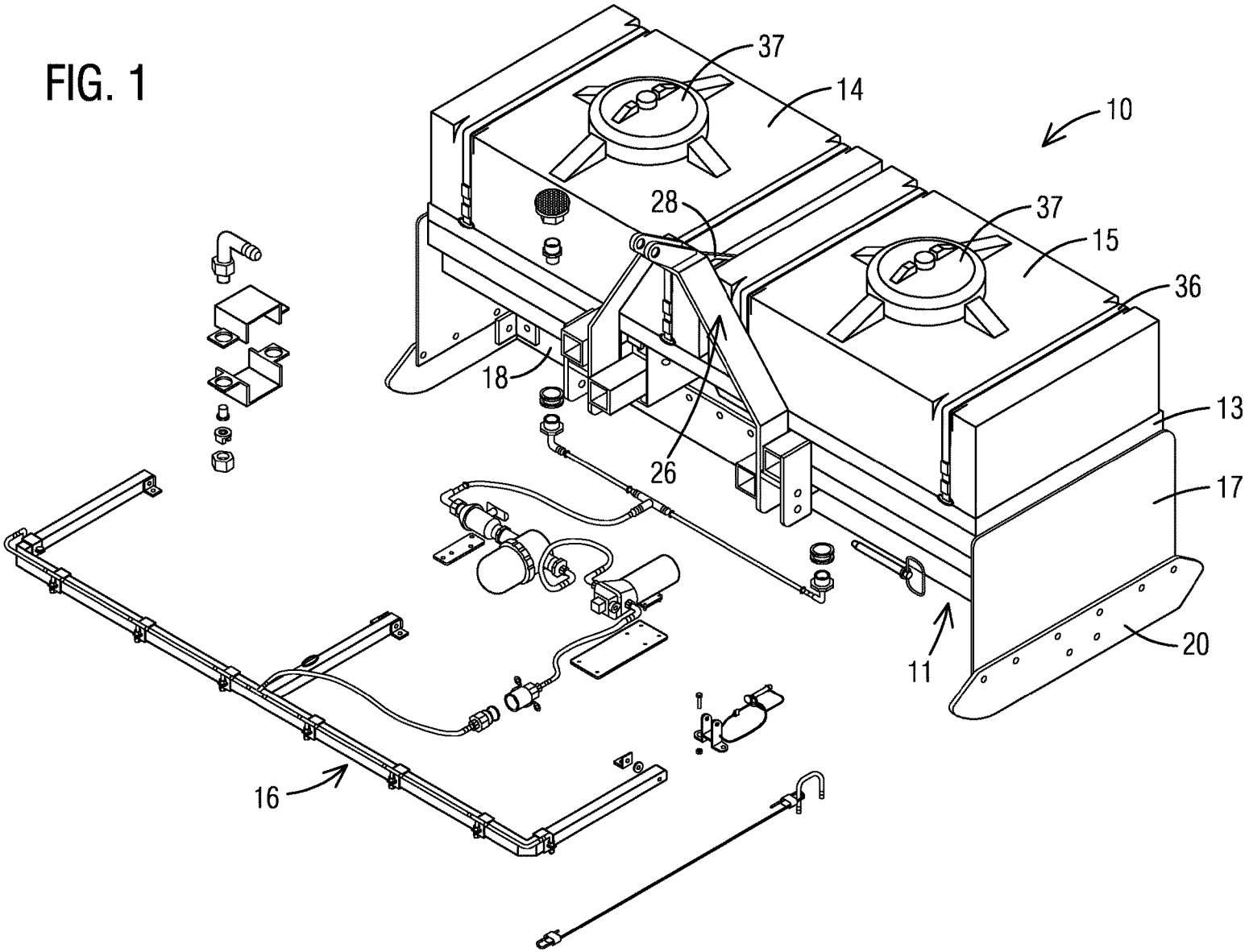
FIG. 1 is an exploded perspective view of a drag box in accordance with the present invention having attached water tanks attached and a water spray system.
Figure 2:
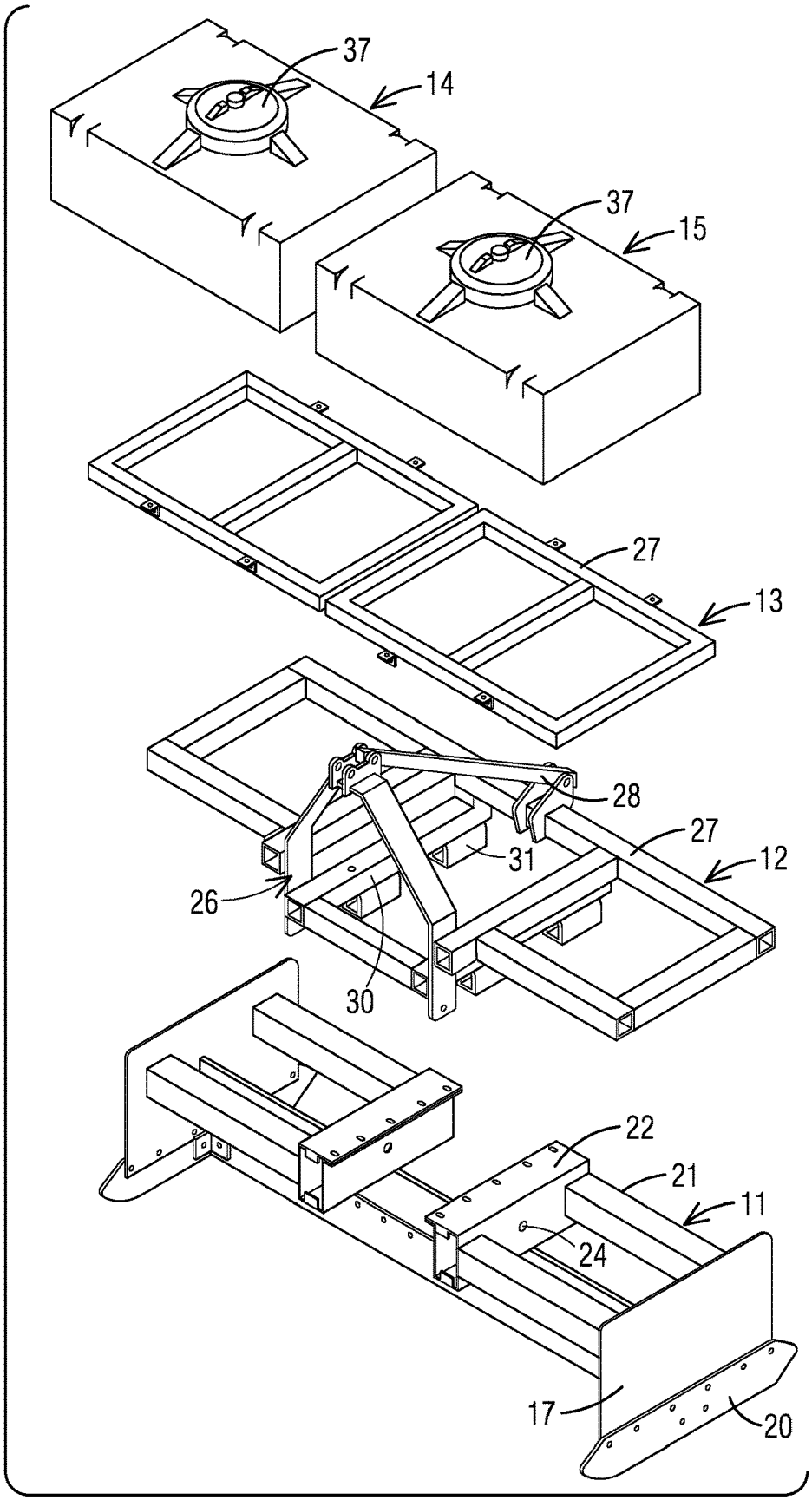
FIG. 2 is an exploded perspective view of the drag box of FIG. 1.

Referring to the drawings, FIGS. 1 through 4, and especially to FIGS. 1 and 2, a drag box 10 can be seen having a blade box frame 11 having a three point hitch frame 12 pivotally attached thereto in FIGS. 1 and 2. The three point hitch frame has a water tank supporting frame 13 supporting a pair of water tanks 14 and 15. FIG. 1 also shows a water sprayer system 16 which is connected to the water tanks 14 and 15. The blade box 11 has a pair of side frame member 17 having a scraping blade 18 attached therebetween. Each side frame member 17 has a shoe or skid plate 20 mounted thereto. The three point hitch frame 12 has a three point hitch 26 for connecting to a tractor or the like. The blade box frame 11 is attached to three point frame 12 at pivot point to allow the blade box frame 11 to pivot on the three point frame 12. The water tank support frame 13 is attached to the three point hitch frame 12 and the water tanks 14 and 15 mounted thereto.

Figure 3:
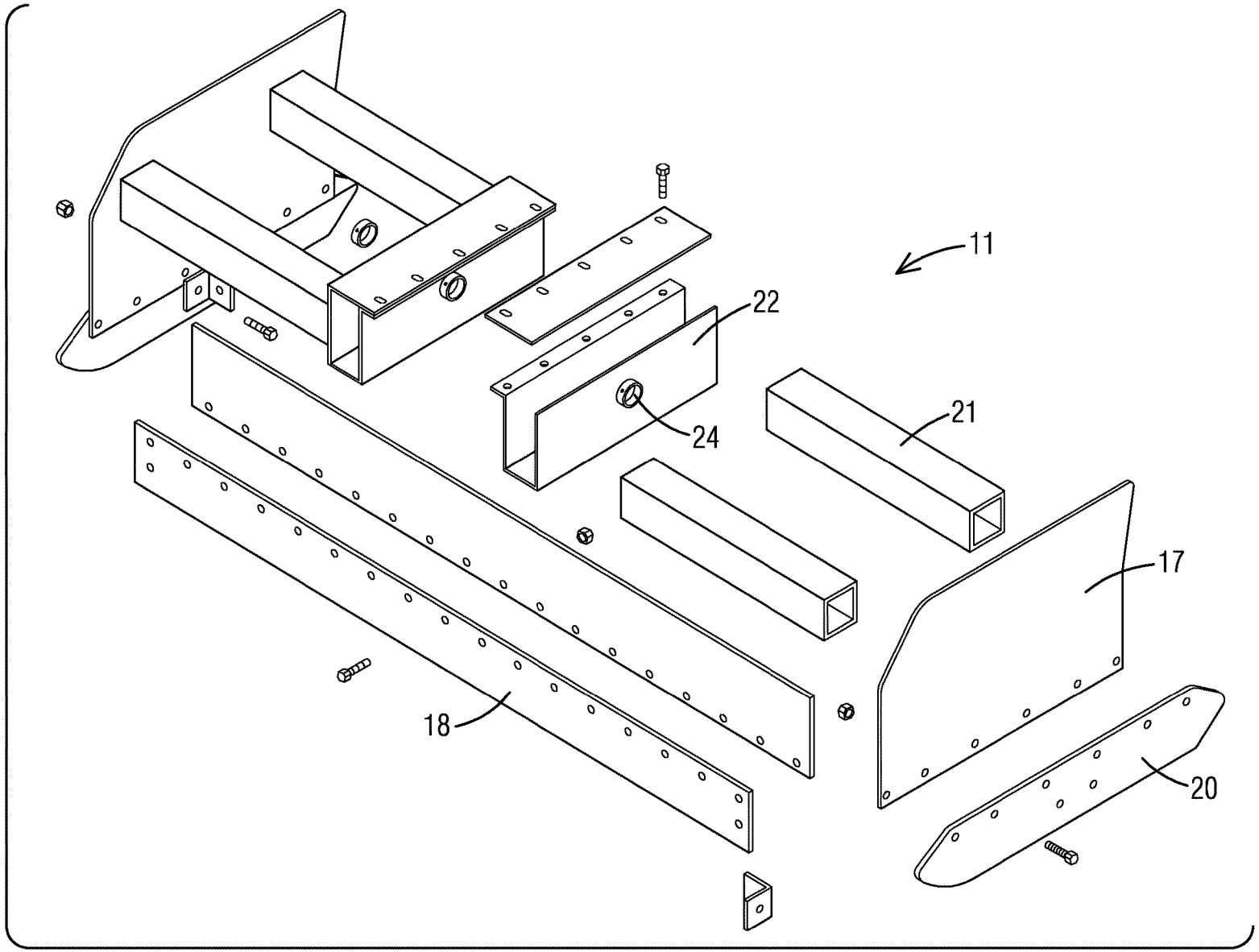
FIG. 3 is an exploded perspective view of a blade box of the drag box of FIGS. 1 and 2.

As seen more clearly in FIGS. 2 and 3, the blade box 11 has the side frame members 17 having he blade 18 extending therebetween and skids 20 mounted to each side frame member 17 for the blade box 11 to ride on. Cross frame members 21 have a pair of cushion support members 22 and 23 each having a pivot point opening 24 therethrough for making a pivotal attachment to the three point hitch frame. The cushion support members 22 and 23 also support the three point hitch frame cushions 31 when the blade box frame is attached to the three point hitch frame 12. Cushions 31 as can be seen are acting as and can be coil springs which allows movement of the blade box 11 while biasing the blade box 11 to the initial scraping position without departing from the spirit and scope of the invention.

Figure 4:
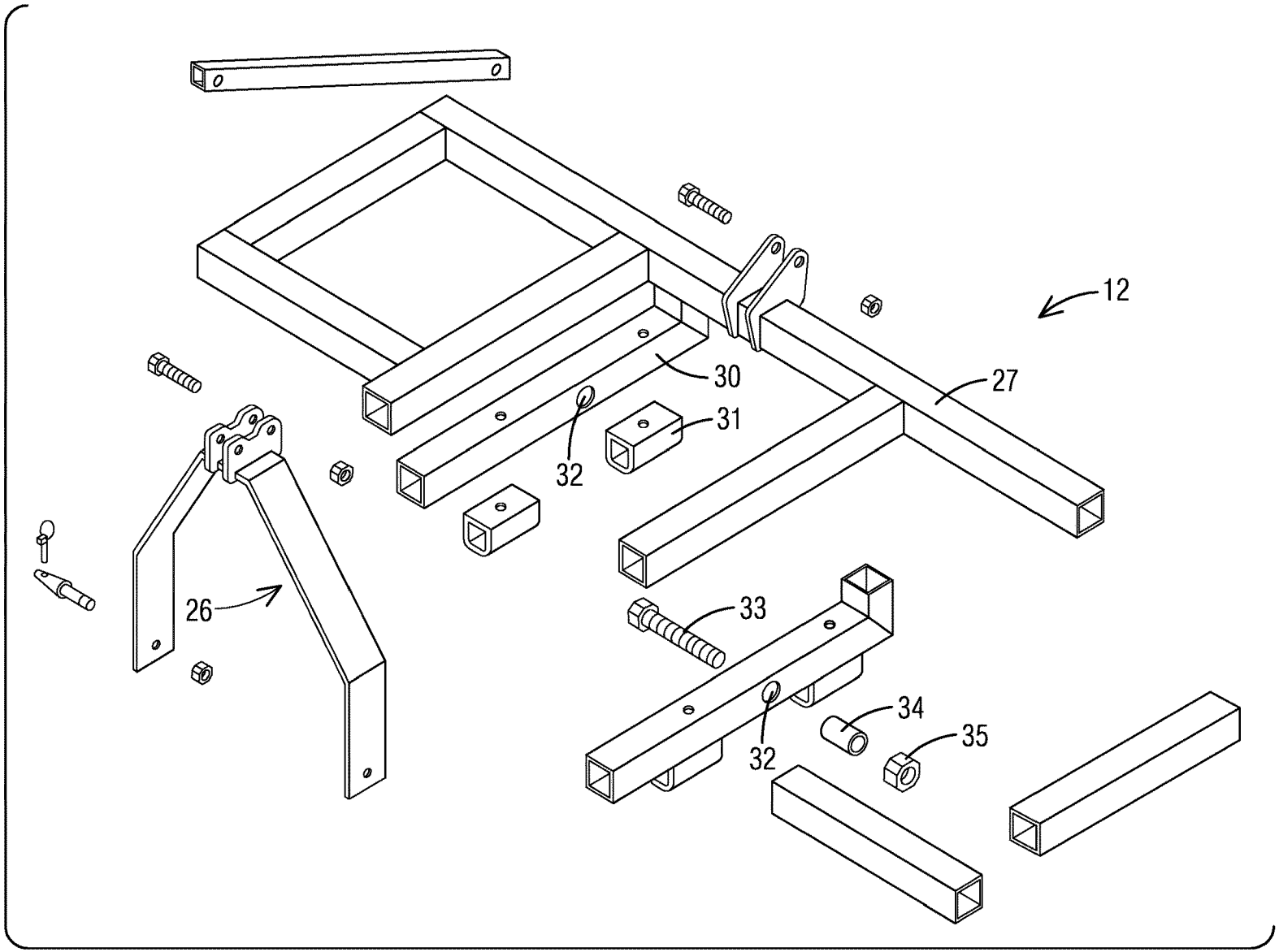
FIG. 4 is an exploded perspective view of the three point hitch and hitch frame of the drag box of FIGS. 1 and 2.

Referring to FIGS. 2 and 4, the three point hitch frame 12 has a three point hitch 26 which allows the three point hitch frame 12 to be rigidly attached to a tractor or the like. An upper support bar 28 is attached between a rear frame member 27 and the three point hitch 26. A pair of cushion support bars 30 are attached between the rear support frame 27 and the three point hitch 26. Each cushion support bar 30 has one or more resilient cushions 31 attached to the bottom side thereof and has a pivot point opening 32 which will align with the pivot opening 24 of the blade box frame 11. The blade box frame 11 and the three point hitch frame 12 are connected with pins or bolts 33 passing through the opening 32 of the three point hitch cushion support bars 32 and through the blade box frame cushion support members pivot openings 24. A bushing 34 is placed in the opening and a nut 35 holds the bolt in place attaching the blade box frame 11 to the three point hitch frame 12 to allow the blade box frame to pivot on the three point hitch frame 12. The three point hitch frame 12 is rigidly attached to the tractor. Thus the blade box frame 11 and attached blade 18 are allowed to pivot on the three point hitch frame 12. The cushions 31 attached to the cushion support bars 30 rest on the cushion support members 22 and 23 of the blade box frame 11 when the blade box frame 11 is attached to the three point hitch frame and limit and cushion the amount of pivot that the blade box frame can make. The resilient cushion 31 holds the blade in position until an obstacle is encountered by the main scrap blade 18. The skids can force a small pivot or tilt of the blade box frame 11 and blade 18 to pass over the obstacle. The flexible cushions will then return the blade box frame to its normal position.

Referring to FIG. 2, the water tank support frame 13 has a plurality of straps latches 36 used to attach the water tanks 14 and 15 to the frame 13. The frame 13 is fixedly attached to the three point hitch frame 12. The water tanks 14 and 15 each have an opening 37 for filling the tanks with water. The water tanks and water therein advantageously add weight to the drag box 10 while at the same time providing water for the spray system 16.

In operation, the drag box 10 is attached to a tractor or other vehicle with the three point hitch 17 and pulled along a surface being scraped. The blade box 11 which has a pivotal attachment to the three point hitch frame rides on skids 20 pulling the blade 18 along a surface being scraped. When the blade box 11 skids contact a rigid object, such as a manhole cover, the blade box 11 will pivot on the three point hitch frame 12 pushing against the resilient cushions 31 with the cushion support members 22. This allows the blade box frame and blade 18 to tilt back to ride over the rigid object in its path. The resilient cushions 31 then maintain pressure on the cushion support members 22 to return the blade box 11 and blade 18 back to its surface scraping position.

It should be clear at this time that a drag box for scraping a road surface or the like which can pass over obstacles in its path has been provided. However the present invention is not to be considered limited to the forms shown which are to be considered illustrative rather than restrictive.

I claim:

1. A drag box apparatus comprising:

a blade box frame having a pair of side frame members each having a skid removably attached thereto for said blade box frame to slide on, said blade box frame having a blade attached between said side frame members and said blade box frame having a pair of cushion support members;

a three point hitch frame having a three point hitch for attaching said three point hitch frame to a vehicle, said three point hitch frame having a pair of cushion support bars each having a resilient cushion mounted thereon and pivotally attached at a pivot point with a pivot pin to said pair of box blade cushion support members and aligned for resting on each said resilient cushion to support pivotal movement of said blade box on said three point hitch frame allowing the tilting of said blade box frame blade when said blade encounters an obstacle; and whereby said drag box has a blade box frame and blade that can move relative to said three point hinge to tilt said blade box frame and blade when said blade encounters an obstacle.

2. The drag box apparatus in accordance with claim 1 in which each said blade box frame support member and three point hitch frame cushion support member has an opening therethrough at a pivot point and each having a bushing mounted therein for a bolt pivot pin.

3. The drag box apparatus in accordance with claim 1 in which said three point hitch frame has a water tank frame attached thereto for supporting a water tank thereon.

4. The drag box apparatus in accordance with claim 3 in which a water tank is attached to said water tank frame on said three point hitch frame.

5. The drag box apparatus in accordance with claim 3 in which a pair of water tanks are attached to said water tank frame on said three point hitch frame.

6. The drag box apparatus in accordance with claim 4 in which said water tank has a spray system operatively attached thereto for spraying water.

7. The drag box apparatus in accordance with claim 1 in which each said blade box frame skid is removably attached to one side member.

8. The drag box apparatus in accordance with claim 1 in which said blade box frame blade is removably attached to said side frame members.

9. The drag box apparatus in accordance with claim 1 in which each said three point hitch frame cushion is removably mounted to a cushion support bar.

* * * * *